United States Patent [19]

Fann et al.

[11] Patent Number: 5,067,758

[45] Date of Patent: Nov. 26, 1991

[54] LOCK HANDLE ASSEMBLY WITH LIMITED ANGULAR MOVEMENT

[75] Inventors: Yaw-Shin Fann; Ming-Shyang Chiou; Ching-Chuan Kuo, all of Chia-Y, Taiwan

[73] Assignee: Tong-Lung Metal Industry Co., Ltd., Chia-Yi, Taiwan

[21] Appl. No.: 632,139

[22] Filed: Dec. 21, 1990

[51] Int. Cl.[5] ..... E05B 1/00

[52] U.S. Cl. ..... 292/347; 292/356; 292/244

[58] Field of Search ..... 292/347, 356, 244, 245, 292/348, 336.3

[56] References Cited

U.S. PATENT DOCUMENTS

| | | | |
|---|---|---|---|
| 2,707,649 | 5/1955 | Young | 292/356 |
| 2,924,480 | 2/1960 | Holland | 292/356 |
| 3,014,748 | 12/1961 | Welch et al. | 292/356 |
| 4,042,268 | 8/1977 | Coglan | 292/347 |
| 4,067,599 | 1/1978 | Ohno | 292/356 |
| 4,343,502 | 8/1982 | Nelson | 292/356 |
| 4,604,879 | 8/1986 | Neary et al. | 292/356 |
| 4,877,278 | 10/1989 | Valley | 292/356 |
| 4,998,760 | 3/1991 | Nixon et al. | 292/347 |

FOREIGN PATENT DOCUMENTS

| | | | |
|---|---|---|---|
| 885342 | 12/1961 | United Kingdom | 292/356 |
| 2095788 | 10/1982 | United Kingdom | 292/244 |
| 2159398 | 12/1985 | United Kingdom | 292/347 |

*Primary Examiner*—Eric K. Nicholson

[57] ABSTRACT

In a lock handle assembly, a lever handle has a rotary shaft to actuate a deadbolt which latches a door. The angular movement of the lever handle is limited by a mechanism including a rotary plate having radially projecting engaging members and mounted on the shaft, a fixed stop member to limit the forward movement of the rotary plate and a releasable stop member to limit the backward movement of the rotary plate. The shaft of the handle is detachably mounted to a casing by being fitted in a sleeve which in turned is mounted to the casing, thereby facilitating the replacement of the handle of the assembly.

3 Claims, 8 Drawing Sheets

LOCK HANDLE ASSEMBLY WITH LIMITED ANGULAR MOVEMENT

BACKGROUND OF THE INVENTION

1. Field of the Invention

This invention relates to a lock handle assembly, used to operate a deadbolt mounted on a door, particularly to a lock handle assembly having a rotary plate attached to a rotary shaft of a lever handle so as to limit the rotation of the handle, and more particularly to one in which the rotary plate can be selectively set in one of two positions so that the lock handle assembly can be converted from a right-hand assembly to a left-hand assembly or vice versa.

2. Brief Description of The Related Prior Art

Lock handle assemblies of the above-mentioned type are known in the prior art. FIG. 1 shows a lock handle assembly which includes a cap-like casing A, a lever handle B with a rotary shaft fitted in a central hole of the casing and a rotary plate C mounted on the rotary shaft to control the degree of rotation of the handle. The rotary plate C is provided with a radial flange D having an elongated slot E. A stop screw F which is attached to the casing A projects through the slot E so that the rotary plate C can rotate only within a limited angle. Since two threaded hollow seats G are provided below the flange D, the stop screw F can be selectively positioned in either of the two threaded hollow seats G so that the handle B can be turned left or right depending on the position of the stop screw F.

While various forms of rotation limiting mechanisms are provided for the rotary plate of the assembly of the above-mentioned type, there is still no provision for changing the lever handle of the assembly to match the converted lock handle assembly. Generally, the lever handles of the lock handle assemblies are shaped to accommodate the physical structure of a hand. Therefore, a right-hand handle is inconvenient for a left-hand operation and also a left-hand handle is inconvenient for a right-hand operation. It is therefore desirable to enable the lock handle assembly to have its handle changed when it is converted to a left-hand from a right-hand assembly, or vice-versa.

SUMMARY OF THE INVENTION

An object of the invention is to provide a lock handle assembly which can be converted into a left-hand from a right-hand assembly or vice versa and whose handle can be easily replaced with a more suitable one.

According to the present invention, a lock handle assembly comprises: a casing having a central hole; a sleeve rotatably fitted in the central hole, and having an inner and outer end respectively extending inwardly and outwardly from the central hole; a lever handle having a rotary shaft detachably fitted in the sleeve and rotatable together with the sleeve; a rotary plate mounted on the sleeve inside the casing, the rotary plate having a radially extending forward engaging member and two radially extending backward engaging members angularly spaced from the forward engaging member at two side of the forward engaging member; a left and right female screw member extending axially inward from the casing at two diametrically opposite positions relative to the sleeve member; a coiled torsion spring disposed around the sleeve member and having a left radial leg to engage the left female screw member and a right radial leg to engage the right female screw member; a first stop member extending axially inward from the casing between the female screw members; and a second releasable stop member extending axially inward from the casing between the female screw members and opposite to the first stop member. The first and second stop members limits the angular movement of the rotary plate. However, the rotary plate can be selectively set at one of two operative positions by releasing the rotary plate from the second releasable stop member so that the assembly can be used for a right-hand or left-hand operation. The lever handle is detachable from the sleeve, thereby permitting the handle to be replaced by a new handle which can be matched with the converted assembly.

The present exemplary preferred embodiments will be described in detail with reference to the accompanying drawings, in which:

DETAILED DESCRIPTION OF THE PREFERRED EMBODIMENT

Figure 1:
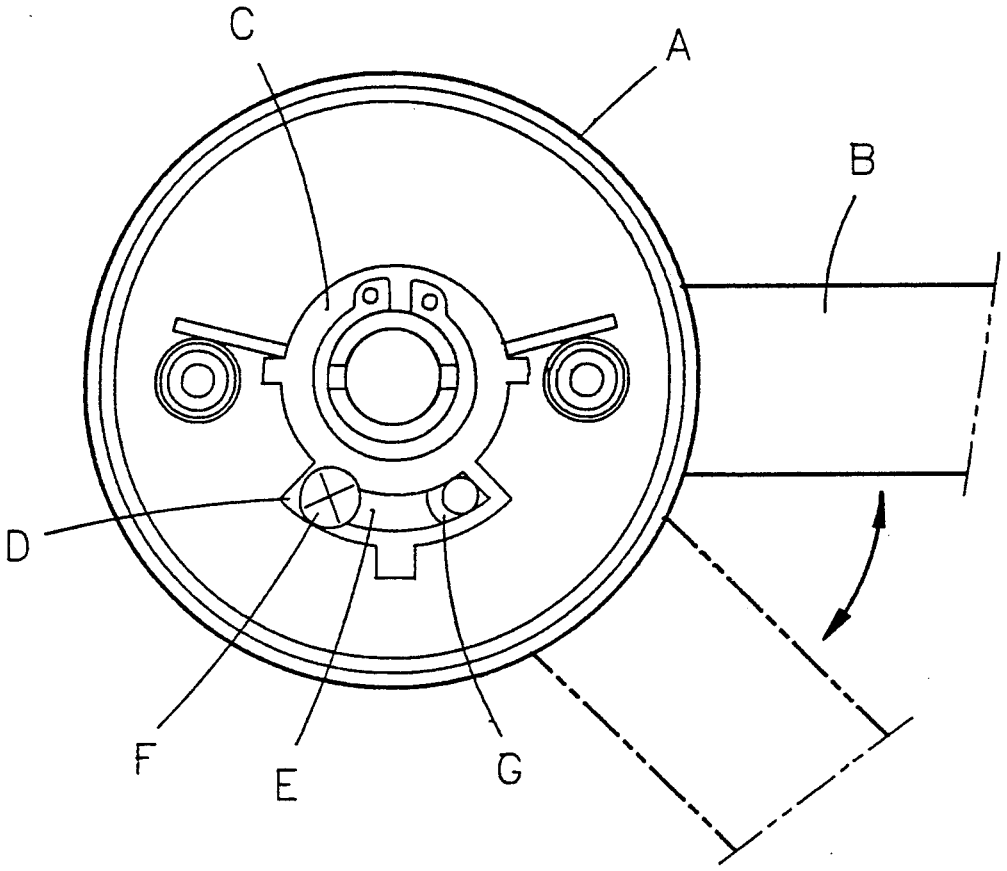
PRIOR ART FIG. 1
FIG. 1 is a lock handle assembly in the prior art.
Figure 2:
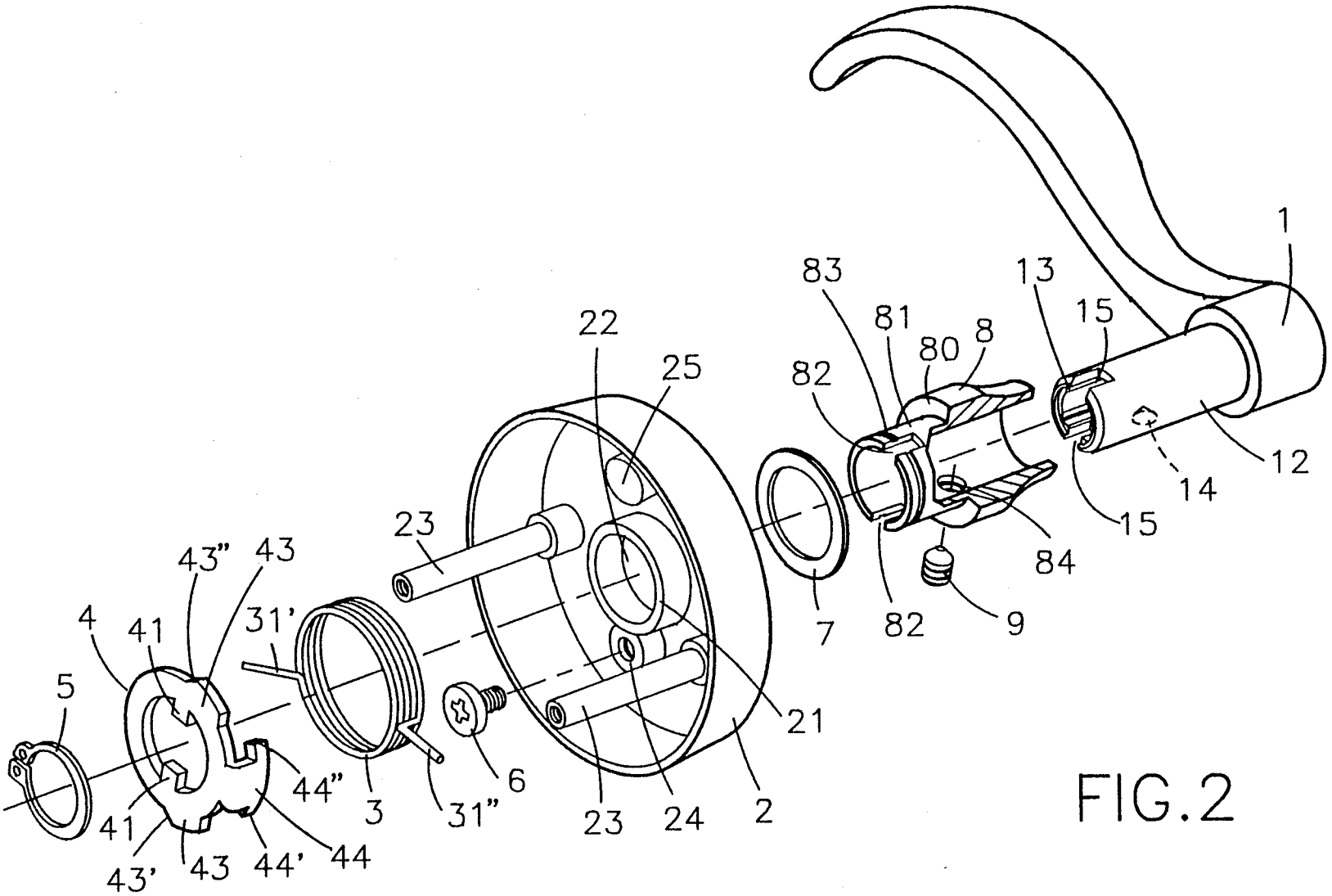
FIG. 2 is an exploded view of a lock handle assembly embodying the present invention.

Referring to FIG. 2, a lock handle assembly embodying the present invention includes a handle 1, a cup-like casing 2, a torsion spring 3, a rotary plate 4, a locking ring 5, a fixed stop member 25, a releasable stop member 6, a packing ring 7, a sleeve 8 and a locking screw 9. The sleeve 8 is inserted into a central hole 22 of an annular member 21 of the casing 2. The shoulder 80 of the sleeve 8 abuts the outer surface of the casing 2 and the neck portion 81 thereof enters in the casing 2. A packing ring 7 is disposed between the shoulder 80 and the casing 2. The handle 1 has a rotary shaft 12 which is inserted into the sleeve 8 and secured thereto with the screw 9. The screw 9 passes through a hole 84 of the sleeve 8 and and engages in a recess 14 of the rotary shaft 12 of the handle 1. Two opposite notches 15 of the shaft 12 are aligned with notches 82 of the sleeve 8. Two connecting female screws 23 extend axially from the casing 2 at two sides of the annular member 21. Also, the fixed stop member 25 and the releasable stop member 6 are attached to the casing 2 adjacent the annular member 21. The releasable stop member 6 is a screw which is threadedly disposed in a threaded hollow seat 24.

The torsion spring 3 is disposed around the annular member 21. The rotary plate 4 is attached to the sleeve 8 by means of two inward radial tongues 41 which engage two notches 82 of the sleeve 8 and the notches 15 of the handle 1. The rotary plate 4 has a forward engaging member 44 and two backward engaging members 43 all of which project radially from the periphery of the plate 4. The forward engaging member 44 has an axially projecting flange with two opposite hooks 44' and 44''. The locking ring 5 is received in an annular recess 83 of the sleeve 8, thereby preventing the plate 41 from being released from the sleeve 8.

Figure 3:
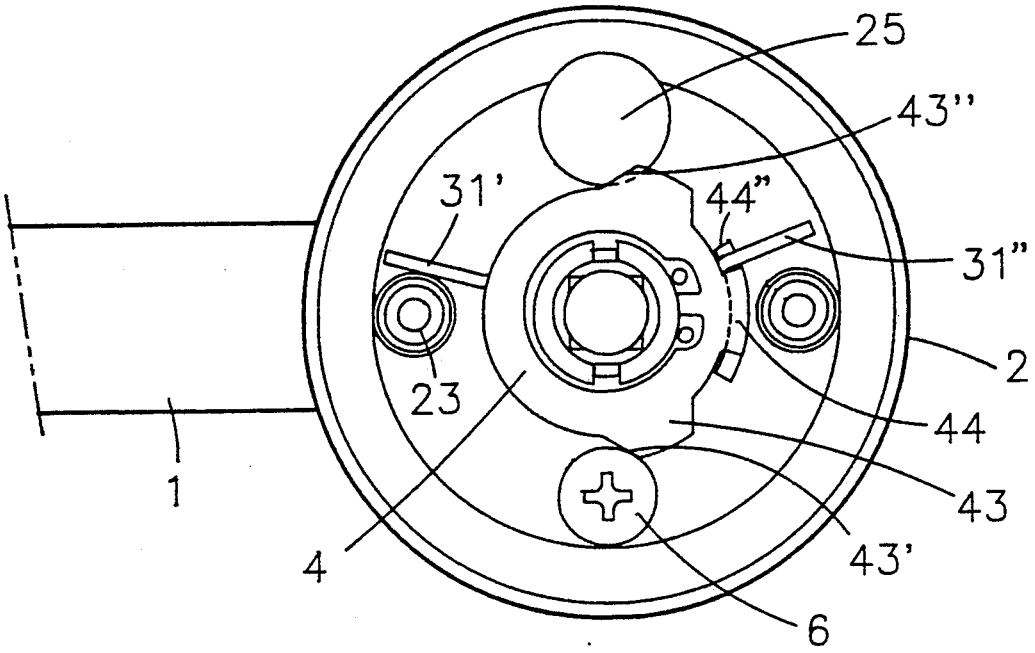
FIGS. 3 and 4 are plan views of the lock handle assembly of FIG. 2 in a right-hand operative position.
Figure 4:
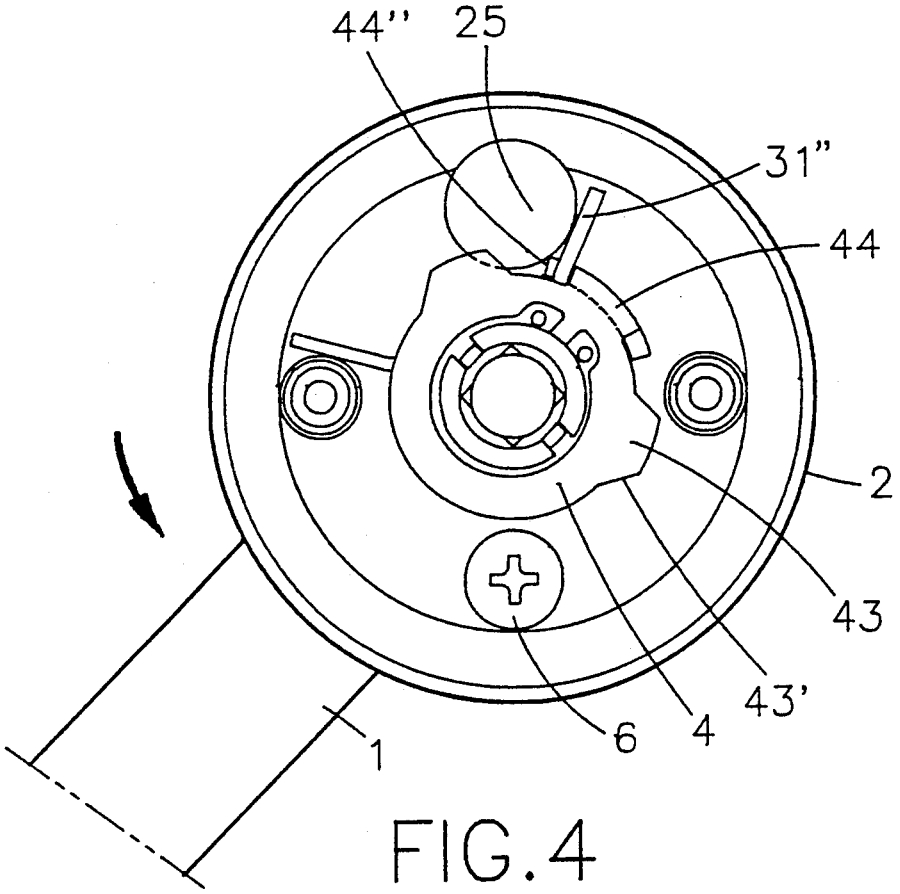

The lock handle assembly of the invention can be configured as either a right-hand or left-hand assembly by changing the position of the rotary plate 4. FIGS. 3 and 4 show the assembly in a right-hand operative position in which the handle 1 can be turned right (the direction of the handle shown in FIG. 4 is to the left because it is viewed from the opposite side of the handle). One leg 31' of the torsion spring 3 engages one of the female screws 23 and the other leg 31'' engage the edge of the forward engaging member 44 adjacent to the hook 44''. When the handle 1 is turned clockwise as shown in FIG. 4, the forward engaging member 44 moves to the fixed stop member 25, pushing the leg 31'' of the torsion spring 3 with its edge adjacent to the hook 44'', and is then stopped by the fixed stop member 25. When the handle 1 is released, the plate 4 is turned backward by the spring 3 and the backward engaging member 43 engages the screw 6 with its engaging edge 43' and stops. In this way, the angle of rotation of the handle 1 is limited by means of the rotary plate 4, the fixed stop member 25 and the releasable stop member 6.

Figure 5:
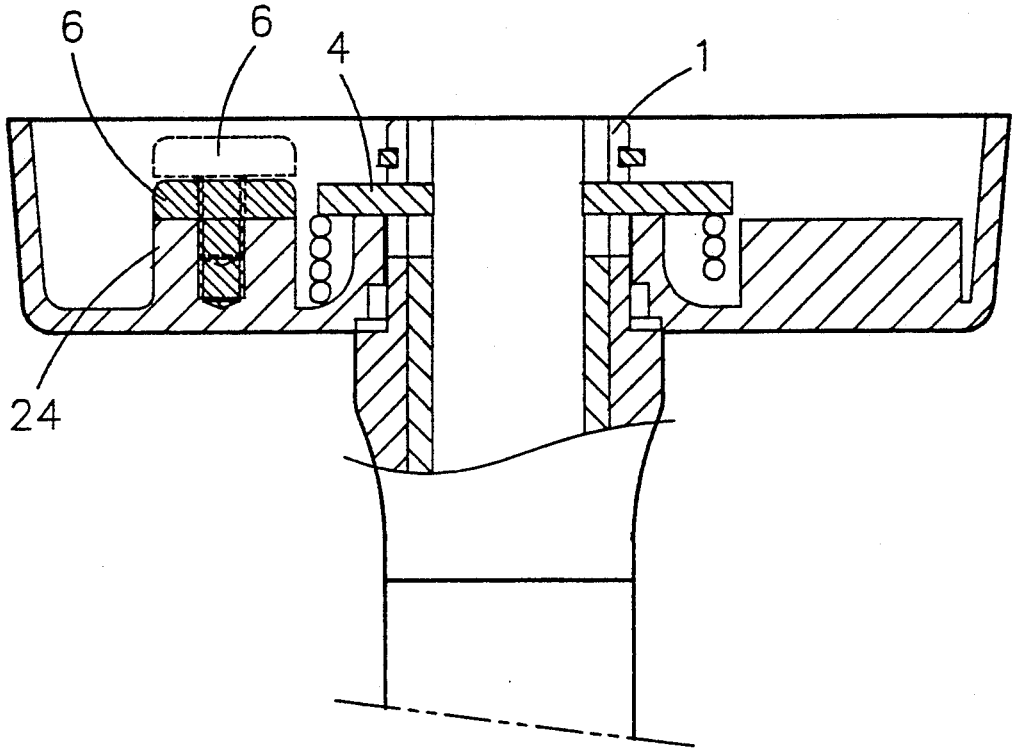
FIG. 5 is a sectional view of the lock handle assembly of FIG. 2.
Figure 6:
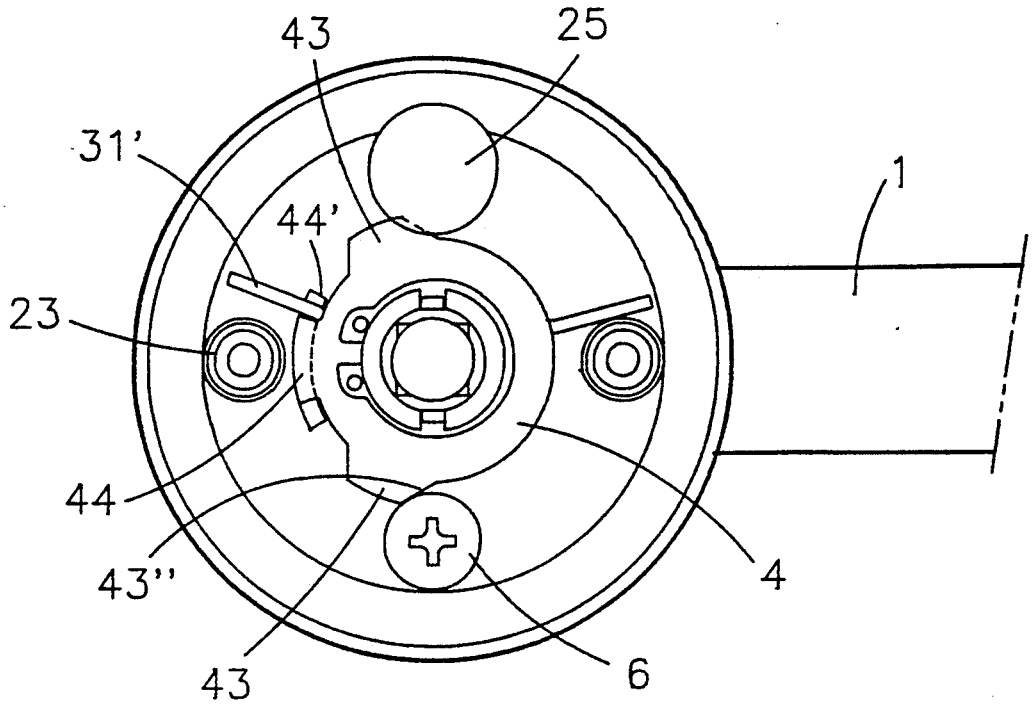
FIGS. 6 and 7 are plan views of the lock handle assembly in a left-hand operative position.
Figure 7:
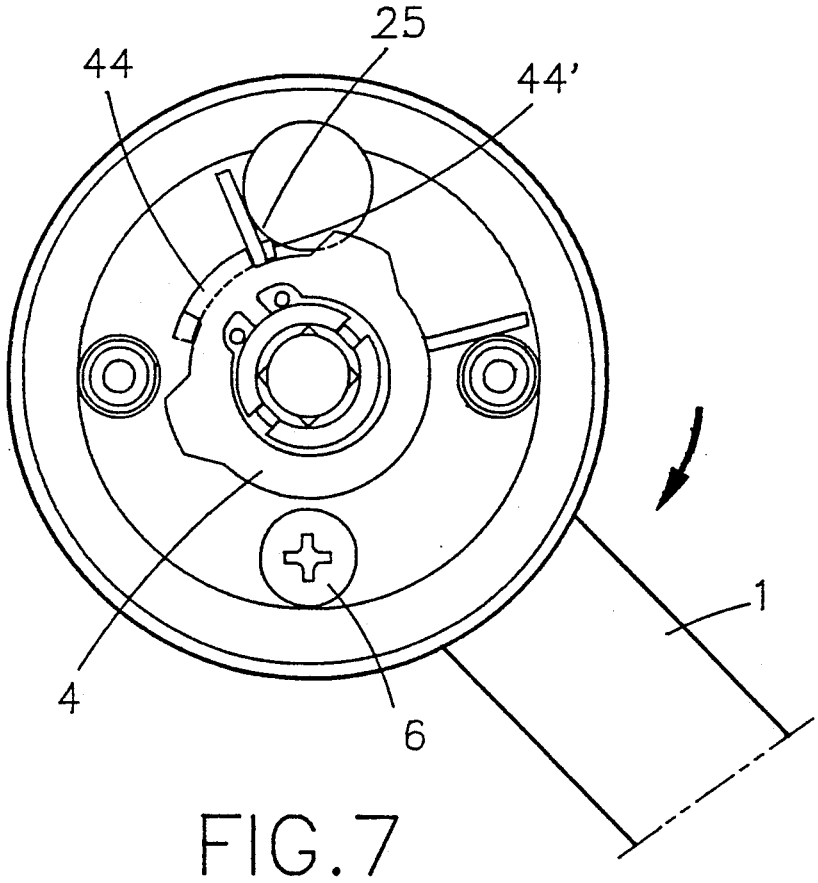

When the lock handle assembly is to be mounted on a left-hand door, the position of the rotary plate must be changed to that shown in FIGS. 6 and 7. In changing the position, the releasable stop member or the screw 6 is first loosened and raised as shown in FIG. 5 so as to permit the backward engaging member 43 to be released from the stop member 6. Then, the rotary plate 4 is turned clockwise from the position shown in FIG. 3 to make the forward engaging member 44 move away from the leg 31'' of the spring 3 and to make the backward engaging member 43 move past the screw 6. When the forward engaging member 44 passes the left female screw 23, its edge adjacent to the engaging hook 44' engages the leg 31' of the spring and the other backward engaging member 43 moves past the screw 6. In this situation, the position of the rotary plate 4 has been changed and thus the screw 6 can be tightened again. The converted left-hand assembly can be operated by turning the handle 1 to the position shown in FIG. 7 in which the forward engaging member 44 engages the fixed stop member 25 with its engaging hook 44'. The releasable stop member 6 will stop the backward movement of the rotary plate 4 by contacting against the engaging edge 43'' of the backward engaging member 43.

The lock handle assembly also permits the handle thereof to be changed to a right-hand handle from a left-hand handle and vice versa. Generally, a right-hand or left-hand handle arranged at the outside of a door can be changed to a left-hand or right-hand handle when it is placed at the inside of the door. The sleeve 8 is provided to ease the attaching and detaching of the handle 1 from the casing 2.

Figure 8:
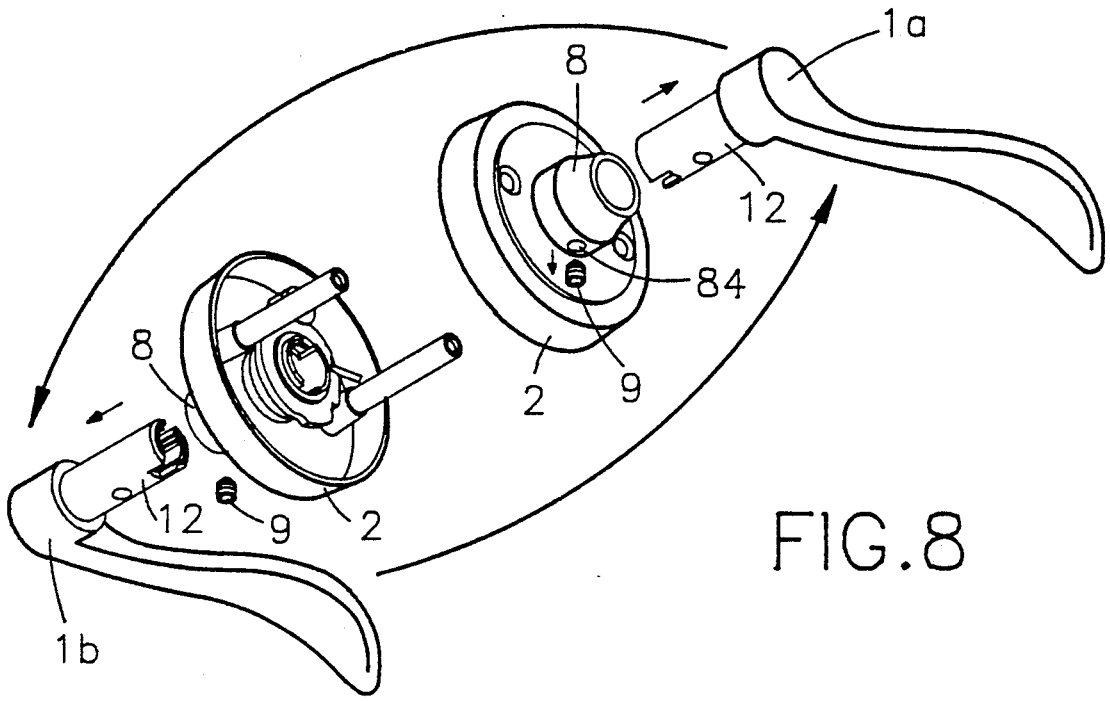
FIG. 8 shows two lock handle assemblies of FIG. 2 to be mounted on a left hand door.
Figure 9:
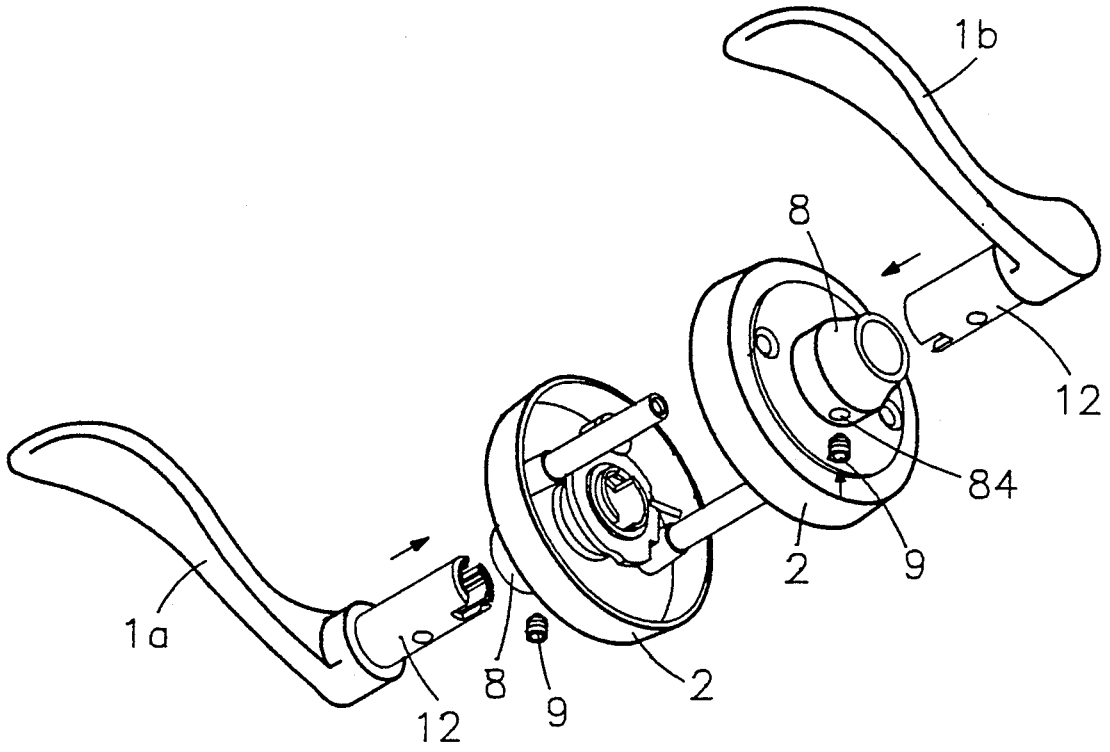
FIG. 9 shows the two lock handle assemblies of FIG. 8 having been converted into right-hand assemblies.

FIG. 8 shows two lock handle assemblies which can be mounted to the inside and outside of a left-hand door. The inside left-hand handle 1*a* and the outside left-hand handle 1*b* are detachably attached to the respective casings 2 through the sleeves 8. The two lock handle assemblies can also be mounted to a right-hand door by changing the positions of the rotary plates 4 and interchanging the handle 1*a* and 1*b*. The handles 1*a* and 1*b* can be interchanged by detaching the handles 1*a* and 1*b* from their respective sleeves 8. Referring to FIG. 9, the previous inside left-hand handle 1*a* becomes an outside right-hand handle and the previous outside left-hand handle 1*b* becomes an inside right-hand handle.

Figure 10:
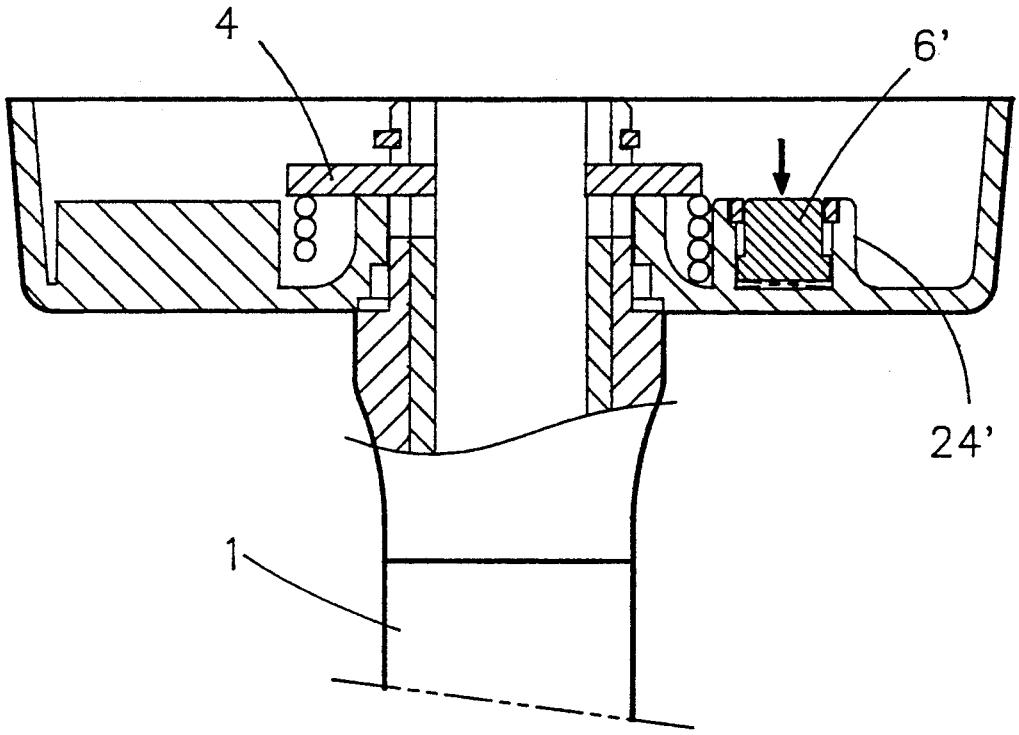
FIGS. 10 and 11 shows the lock handle assembly of FIG. 2 but with a different releasable stop member.
Figure 11:
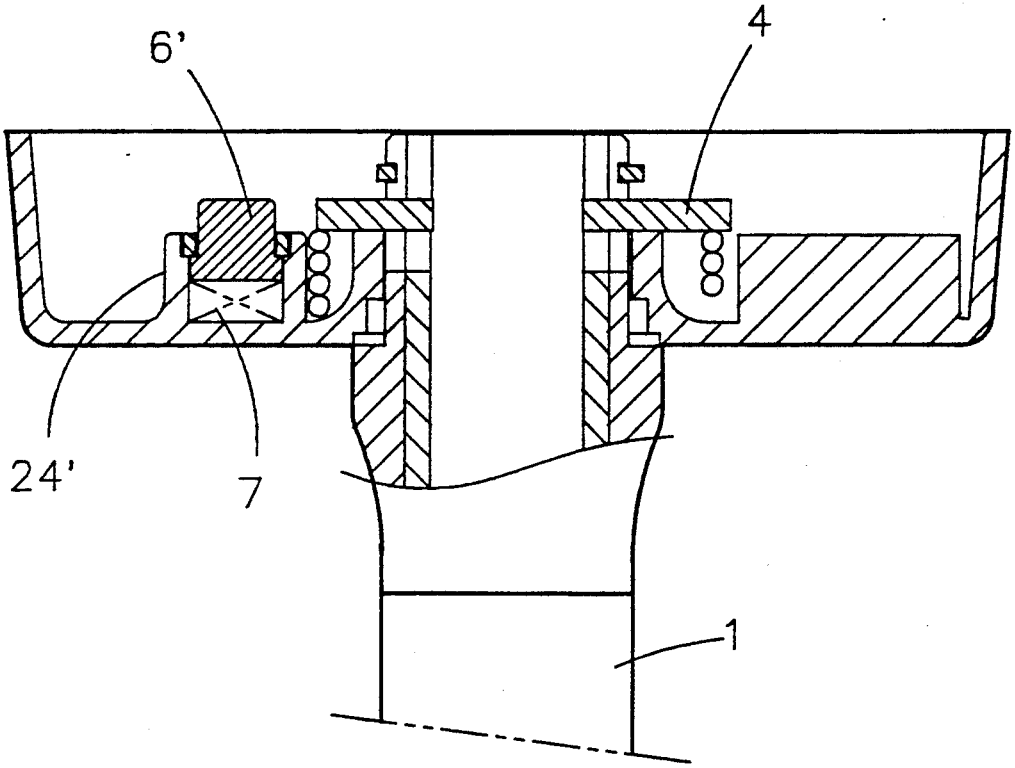

FIGS. 10 and 11 show an alternative releasable stop member 6' that can be used in the lock handle assembly of the present invention. The stop member 6' a stud received in a hollow seat 24' in which a compression spring 7 is provided. The stop member 6' is normally biased upward to an operative position. Like the stop member 6, the stop member 6' can be depressed to permit one of the backward engaging members 43 to move past the stop member 6' when the position of the rotary plate 4 is to be changed, With the invention thus explained, it is apparent that numerous modifications and variations can be made without departing from the scope of the invention. It is therefore intended that the invention be limited only as indicated in the appended claims.

I claim:

1. A lock handle assembly comprises:

a casing having a central hole;

a sleeve rotatably fitted in said central hole, and having an inner and outer end respectively extending inwardly and outwardly from said central hole;

a lever handle having a rotary shaft detachably fitted in said sleeve and rotatable together with said sleeve;

a rotary plate mounted on said sleeve inside said casing, said rotary plate having a radially extending forward engaging member and two radially extending backward engaging members angularly spaced from said forward engaging member at two sides of said forward engaging member;

a left and right female screw member extending axially inward from said casing at two diametrically opposite positions relative to said sleeve member;

a coiled torsion spring disposed inside said casing around said central hole and having a left radial leg to engage said left female screw member and a right radial leg to engage said right female screw member;

a first stop member extending axially inward from said casing between said female screw members;

a second releasable stop member extending axially inward from said casing between said female screw members and opposite to said first stop member;

said rotary plate being selectively set at one of a first operative position and a second operative position, said forward engaging member being adjacent to said left female screw member when in said first operative position, said forward engaging member being adjacent to said right female screw member when in said second operative position;

said forward engaging member moving toward said first stop member carrying said left radial leg of said torsion spring away from said left female screw member when said rotary plate is turned while it is in said first operative position, one of said backward engaging members moving toward said second releasable stop member by the action of said left radial leg when said rotary plate is released, the angular movement of said handle being limited by said forward engaging member and said one backward engaging member, said forward engaging member moving toward said first stop member carrying said right radial leg of said torsion spring away from said right female screw member when said rotary plate is turned while it is in said second operative position, the other one of said backward engaging members moving toward said second releasable stop member by the action of said right radial leg when said rotary plate is released while it is in said second operative position, the angular movement of said handle being limited by said forward engaging member and said other one of said backward engaging member when said rotary plate is in said second operative position, said lever handle being detachable from said sleeve, thereby permitting said handle to be replaced by a new handle to match the used position of said rotary plate.

2. A handle lock assembly as claimed in claim 1, wherein said second releasable stop member includes a headed screw and a threaded hollow seat to receive said headed screw.

3. A handle lock assembly as claimed in claim 1, wherein said second releasable stop member includes a stud, a hollow seat to receive said stud, and a spring disposed in said hollow seat to urge said stud upward.

* * * * *